United States Patent [19]

Gerhardt

[11] 4,075,014

[45] Feb. 21, 1978

[54] COLOR PICTURE DEVELOPMENT PROCESS

[75] Inventor: Wolfgang Gerhardt, Lutjenmoor, Germany

[73] Assignee: Tetenal Photowerk Walter Grabig, Schutzenwall, Germany

[21] Appl. No.: 657,486

[22] Filed: Feb. 12, 1976

Related U.S. Application Data

[63] Continuation-in-part of Ser. No. 361,425, May 18, 1973, abandoned.

[30] Foreign Application Priority Data

Mar. 17, 1973 Germany ..... 2313310

[51] Int. Cl.[2] ..... G03C 7/16; G03C 5/32; G03C 5/30

[52] U.S. Cl. ..... 96/22; 96/60 BF; 96/66.3

[58] Field of Search ..... 96/66, 22, 55, 60, 66.3

[56] References Cited

U.S. PATENT DOCUMENTS

| | | | |
|---|---|---|---|
| 2,197,017 | 4/1940 | Wood | 96/66.5 |
| 2,306,923 | 12/1942 | Wood | 96/66.5 |
| 2,311,428 | 2/1943 | Wood | 96/66 R |
| 3,372,030 | 3/1968 | Jacobson | 96/55 |
| 3,582,322 | 6/1971 | Edens et al. | 96/22 |
| 3,647,452 | 3/1972 | Hendess et al. | 96/55 |
| 3,741,763 | 6/1973 | Amano et al. | 96/22 |
| 3,879,202 | 4/1975 | Yamaguchi | 96/22 |

OTHER PUBLICATIONS

Mason, Photographic Processing Chemistry, 1966, pp. 39–44.

*Primary Examiner*—Mary F. Kelley
*Attorney, Agent, or Firm*—Ernest F. Marmorek

[57] ABSTRACT

The invention relates to a color-positive process for producing a color surface picture using color paper having diffusion-resistant and protected color couplers or plastic-coated or plastic uncoated color paper of color negatives, and features color developing the picture at a temperature in the range of from about 20° C to about 50° C with a developer having added thereto a development accelerator having the formula:

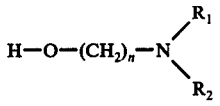

wherein $R_1$ and $R_2$ are H, $CH_3$, or $CH_2$—$CH_3$ and "*n*" is in the range of from 1 to 4, bleach fixing and stabilizing the picture in a solution having a pH from about 5.5 to about 6.0 without an intermediate step of washing or a stop-fixing bath, and thereafter, washing the picture.

8 Claims, No Drawings

COLOR PICTURE DEVELOPMENT PROCESS

CROSS-REFERENCE TO A RELATED APPLICATION

This is a Continuation-in-Part application of application Ser. No. 361,425, filed May 18, 1973 now abandoned.

BACKGROUND OF THE INVENTION

The invention relates to a color-positive process for producing a color surface picture using color paper having diffusion-resistant and protected color couplers or plastic-coated or plastic uncoated color paper of color negatives.

There are known developer sets available for both the professional and amateur photographers to process color pictures in a laboratory from color negative originals. Generally, the exposure of the color paper is carried out in a magnifying unit using subtractive or additive color control. The known developer sets vary and often include three or five stages depending upon the particular chemicals used.

For example, the Agfacolor development process for color papers includes the following stages:

First, a color developer is used, next is an essential step of washing, third is a stop-fixing bath, next is an optional intermediate washing, fourth is a bleach-fixing bath, next is the final washing, the fifth essential stage is a light-protection bath which is followed by a buffer or stabilizing bath and finally drying.

The Agfacolor developing process is carried out at a temperature in the range of from about 20° to about 25° C and is suitable for automatic development and for development in small laboratories. The washing steps are carried out with water.

The five-stage process for Kodak color paper using known chemicals includes the following stages:

First, color developer, second, stop-fixing bath, next is an optional washing, third is a bleach-fixing bath which is followed by an optional washing, fourth is a fixing bath which is also followed by an optional washing, and fifth is a buffer bath followed by drying. This process is carried out at a temperature of about 25° C and may be used for automatic development and in small laboratories.

Generally, the three-stage process includes the steps of first, color developer, then bleach-fixing bath, and finally stabilizing bath. One known three-stage process is unsuitable for processing uncoated papers because of the chemicals used and can only be used with polyethylene paper. Another known three-stage process is suitable only for automatic development at a temperature of from about 31° C to about 35° C.

The known development processes suitable for relatively low temperatures require long reaction times and, in some cases, require several process baths and intermediate washings. The intermediate washings have a considerable influence on the process because there is a possibility that the stop-fixing solution could be carried into the bleaching solution for the three-stage process and in the five-stage process there is a possibility that the stop-fixing solution could be carried into the bleach-fixing solution in the absence of an intermediate washing.

The following Table 1 summarizes known color-positive processes for making color surface pictures for use in an automatic development or a small laboratory.

Table 1

| | Process name and paper types | | | |
|---|---|---|---|---|
| Necessary baths/ procedure | p122 Ektaprint RC 20 and Prof. | Ektaprint 3 - bath RC 30 and RC 37 | Agfacolor 60/82 MCN 111 MCS 117 Type 4 Type 7/Type 4 | Agfacolor AcP 85/86 MCN 310 Type 4 MCS 317 Type 4 |
| Color developer | 6–7 min. 29.5° C | 3.5 min 31° C | 3.0 min 25° C | 1 min 50 sec. 35° C |
| Intermediate washing | — | — | approx. 1.75 min | — |
| Stop-fixing bath | 2 min 28° C | — | 1.75 min 25° C | — |
| Washing | 2 min | — | 1–2 min | — |
| Bleaching bath | 2 min 28–30° C | — | — | — |
| Washing | 2 min | — | — | — |
| Bleach-fixing | — | 1.5 min 31° C | 3.0 min 29° C | 2.45 min 25° C |
| Fixing bath | 4 min 28–30° C | — | — | — |
| Washing | 4 min 28–30° C | 2 min | 5.5 min 24–25° C | 2.45 min 15–30° C |
| Stabilizing bath | 2 min | 1 min | 1.5 min | 55 sec |

As compared to the prior art, the present invention provides a process for producing a color surface picture using color paper having diffusion-resistant and protected color couplers or plastic-coated or plastic uncoated color papers of color negatives by use of an automatic machine or a small laboratory and further features a short development time.

SUMMARY OF THE INVENTION

The present invention relates to a color-positive process for producing a color surface picture using color paper having diffusion-resistant and protected color couplers or plastic-coated or plastic uncoated color paper of color negatives, and features the steps of color developing the picture at a temperature in the range of from about 20° C to about 50° C with a developer having added thereto a development accelerator having the formula:

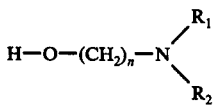

wherein $R_1$ and $R_2$, are H, $CH_2$, or $CH_2$—$CH_3$ and "*n*" is in the range of 1 to 4, bleach fixing and stabilizing the picture in a solution having a pH from about 5.5 to about 6.0 without an intermediate step of washing or a stop-fixing bath, and thereafter, washing the picture.

Surprisingly, it has been found that benzotriazole or substituted benzotriazoles such as aminobenzotriazole, methylbenzotriazole, and chlorobenzotriazole inhibit fogging during the bleaching.

Further objects and advantages of the invention will be set forth in part in the following specification and in part will be obvious therefrom without being specifically referred to, the same being realized and attained as pointed out in the claims hereof.

The invention accordingly comprises the several steps and relation of one or more of such steps with respect to each of the others, all as exemplified in the following detailed disclosure, and the scope of the application of which will be indicated in the claims.

DESCRIPTION OF THE PREFERRED EMBODIMENTS

In carrying the invention into effect, several embodiments have been selected for description in the specification.

Generally, the three stage process according to the instant invention includes a development process for color papers having diffusion-resistant and protected color couplers or plastic-coated or plastic-uncoated color papers being developed at a temperature of from about 20° to about 50° C, preferably between the temperatures from 20° to 25° C.

In order to obtain a high developing speed at ordinary room temperatures, a hydroxyalkylamine is added as a development accelerator to the color developing solution. The hydroxyalkylamine has the following formula:

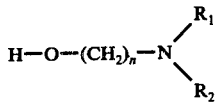

wherein $R_1$ and $R_2$ are H, $CH_3$, or $CH_2$—$CH_3$ and "$n$" is in the range of from 1 to 4. The amount of the hydroxyalkylamine used is preferably in the range of from about 0.4 to about 5.0 ml per liter of solution. In the cases of emulsions with protected color-couplers, it is desirable to add glycolether having the formula:

$$HO—(CH_2)_n—O—(CH_2)_n—OH,$$

wherein "$n$" is in the range of from 1 to 4. This assures the development of all three color layers and preferably from about 5 to about 15 ml per liter is used.

In accordance with the instant invention, the bleach fixing stage is carried out in the presence of anti-fogging agents as additives to the bleach fixing bath. Surprisingly, it has been found that benzotriazole or substituted benzotriazoles such as amino benzatriazole, methylbenzotriazole and chlorobenzotriazole possess bleach anti-fogging properties.

It is preferable to use an acidic pH range of from about 5.5 to about 6.0 with high buffer effect. In addition, the bleach fixing of the color paper is carried out without a white coupler.

The addition of white couplers to a bleach fixing bath containing amino benzotriazole does not appear to have a discernible effect on the picture obtained.

Generally, the developer set is of the type known and includes a developer substance, a preservative, an alkali, a retarder, a diffusion regulator, and, of course, the developer accelerator according to the invention. The developer substance, preservative, and retarder substances are known from the prior art. The retarder is an anti-fogging agent and can be potassium bromide or some other suitable and known chemical. The diffusion regulators are usually temperature dependent and are typically mono-alkylated-$\alpha$, $\omega$-dihydroxyethers. These also contribute to the accelerated development, specifically in the lower color layers. This type of developer set is insensitive to fogging and post development in the color papers when it is used as a once-only developer in mini-processes or roll tanks for developing time exceeding about 1 to 3 minutes at temperatures above about 41° C.

The bleach-fixing substance can be an ethylene diamine tetraacetic acid iron-sodium complex, ammonium thiosulfate, sodium sulfite and a halogen-alkylated amino benzotriazole having a strong post-development inhibiting effect and an ultraviolet (UV) absorber. This results in a bleach-fixing bath having a very rapid stopping action which is obtained because of the halogen-alkylated amino benzotriazole possessing a strong post-development inhibiting effect. In addition, the color papers are bleach fixed in an acid having a pH range of about 5.5 to about 6.0 with a high buffer effect. Surprisingly, bleach fixing is carried without a white coupler and picture whites are obtained even on washing in iron-containing water. Furthermore, the bleach fixing is carried out in the presence of an UV-light-absorbing substance which after washing remains in the emulsion to an adequate extent and protects the image dyes substantially from bleaching under the action of light.

Generally, one liter of color developer can be used to develop 0.5 $m^2$ color paper. If the color developer is used in the so called dish procedure and developed at a relatively constant temperature and time, the development intensity declined even before reaching the utilization degree (0.5 $m^2$). On increasing the development time or increasing the temperature, the fogging values increase and the color density curve flattens. Uniformity of the reproducibility by the dish development procedure depends considerably on the temperature of the color developer, the exact observation of the color time, and the obtained utilization of the bath.

The following is a color developing solution according to the invention and suitable for developing an exposed color paper in about 60 seconds at about 23° C:

| | |
|---|---|
| hydroxylammonium sulfate | 2.6 g |
| N-ethyl-hydroxyethyl-p-phenyldene diamine sulfate | 8.0 g |
| diethylene glycolmonoethyl ether | 14.0 ml |
| sodium sulfite | 2.2 g |
| potassium bromide | 0.3 g |
| CALGON (trademark) | 3.0 g |
| ethanolamine | 2.8 ml |
| dry potash | 100.0 g |
| dry potassium hydroxide | 6.0 g |
| water to make up | 1,000.0 ml |
| pH-value | about 11.35 to about 11.45 |

Subsequently, bleach fixing was carried out 75 seconds at about 23° C in a bath having the following composition:

| | |
|---|---|
| EDTA-NaFe III - complex | 84.0 g |
| EDTA-acid | 10.0 g |
| dry sodium sulfite | 12.0 g |
| ammonium dihydrogen phosphate | 22.0 g |
| ammonium thiosulfate | 200.0 g |
| ammonia D 091 25% (ca.) | 10.0 ml |
| water to make up | 1,000.0 ml |

-continued

| | |
|---|---|
| pH-value | from about 6.70 to about 6.90 |

This solution does not include anti-fogging agents. After use of this solution, the picture was washed and dried in the usual manner and fog values were measured with a densitometer (Macbeth RD 519 Status D-Filter), the following values were obtained:

yellow:0.23
purple:0.22
blue-green:0.17

To the above bleach fixing bath, 1 gram of aminobenzotriazole was added and the following fog values were obtained:

yellow:0.19
purple:0.18
blue-green:0.12

In order to compare the above to the prior art according to DT-OS 2,129,202, 3 grams of acetoxime were added to the bleach fixing bath instead of the amino-benzotriazole and the following fog values were obtained:

yellow:0.22
purple:0.22
blue-green:0.14

The higher fog level in the case of the oxime addition manifested a color shift in the picture towards the purple-red due to the destruction of the blue-green dye or to an incomplete restoration of the blue-green dye in the bleach fixing bath. The benzotriazole resulted in the best fog values.

Additional experiments were conducted to compare the effect of white couplers to the instant invention. White couplers according to DT-OS 2,129,202 in the form of 3 grams of 1-(p-sulfophenyl)-3,4 dimethylpyrazolone-5 were added to the bleach fixing bath instead of the amino-benzotriazole and the following fog values were obtained:

yellow:0.20
purple:0.17
blue-green:0.15

The same bleach fixing bath with the white couplers was used but 1 gram of aminobenzotriazole was added and the following fog values were obtained:

yellow:0.18
purple:0.17
blue-green:0.13

This shows that the addition of white couplers to the bleach fixing bath has little effect if the bleach fixing bath contains aminobenzotriazole. Thus, white couplers need not be used at all for a composition according to the instant invention.

Generally, the processes disclosed in the DT-OS 2,059,988 and DT-OS 2,129,202 are carried out at a temperature of about 40° C. It is well known that the chemical reactions take place at a faster rate at higher temperatures so that the processing time is shorter. In photography laboratories and particularly for amateur photography laboratories, the control of the temperature of the processing baths represents the problem. The problem arises because for the higher processing temperature, the temperature tolerance is much smaller in order to guarantee reputable development results for relatively short time periods. In practice, the temperature must be controlled through expensive temperature monitored heating and cooling systems for large installations.

In contrast, the instant process can be carried out at ambient room temperature.

A further experiment using the developing and bleach fixing bath according to the above mentioned German patent was carried out with the following solutions:

| Color-developing solution | |
|---|---|
| N-butyl-N-w-sulfobutyl-p-phenylene-diamine | 6 g |
| dry sodium sulfite | 4 g |
| hydroxylamine "HCL" | 2 g |
| potassium carbonate | 100 g |
| potassium bromide | 1 g |
| sufficient water to make up | 1,000 ml |

| Bleach-fixing bath | |
|---|---|
| acetonoxime | 3 g |
| "EDTA-Na 2" - salt | 6 g |
| "EDTA-Fe III-Na" - complex | 40 g |
| ammonium thiosulfate | 200 g |
| "AC 452 (Agfa Gevaert)" (white coupler) | 3 g |
| dry sodium sulfite | 4 g |
| sufficient water to make up | 1,000 ml |

The development of a picture using these solutions included about 60 seconds in the developing solution and about 60 seconds in the bleach fixing solution at about 40° C, then washing and drying in the usual manner. These typical known solutions are not considered very suitable for use at ordinary ambient room temperature. For such temperatures, the time required is about 5 to 8 times longer than the time period required for the instant process. Moreover, for a temperature of about 23° C, these known solutions cannot be used at all for a development time of about 60 seconds and a bleach fixing time of about 75 seconds.

The following is a further example of a developing solution according to the instant invention:

| | |
|---|---|
| benzyl alcohol | 15.0 ml |
| diethanolamine sulfite | 2.0 ml |
| diethylene glycol ether | 2.0 - 5.0 ml |
| hydroxylammonium sulfate | 3.0 g |
| sodium phosphate | 3.0 g |
| potassium bromide | 0.6 g |
| sodium sulfite | 1.3 g |
| sodium carbonate | 32.0 g |
| potassium hydroxide | 2.0 g |
| 1) 2-amino-5-diethylaminotoluol hydrochloride or | |
| 2) 4-N-ethyl-4-N(2-methylsulfoaminoethyl)-2-methyl-b-phenyldiamine-sesquisulfate-monohydrate or | |
| 3) 5-N-ethyl-5-N-(2-hydroxyethyltoluol-2,5-diammonium sulfate-monohydrate or | |
| 4) N-ethyl-oxethyl-p-phenyllene sulfate or | |
| 5) mixtures of 2) and 4) or of 3) and 4 | 3 - 5 g |
| water to make up | 1,000.0 ml |
| pH being from about | 10.75 to about 10.85 |

Another bleach fixing bath according to the invention is as follows:

| | |
|---|---|
| "EDTA-NaFe" | 70 g |

-continued

| | |
|---|---|
| "EDTA-Na 4" | 15 g |
| sodium sulfite | 8 g |
| benzotriazole (shown below) | 0.3 - 1.2 g |
| ammonium bromide | 20 g |
| ammonium thiosulfate | 150 g |
| UV-absorber | 1 g |
| sodium hydrogen diacetate | 13 g |
| water to make up | 1,000 ml |

The benzotriazole can be 5-amino-1H-benzotriazole or 5-chloro-1H-benzotriazole or 5-methyl-1H-benzotriazole or 5-chlorethyl-1H-benzotriazole. The acid pH value of the bleach fixing bath is from about 5.6 to about 5.9. This has a stopping effect after the development stage or supports the effects of the benzotriazole and of the ammonium bromide for the prevention of bleach fixing veils. The pH value of the bleach fixing solution increases and thereby assures the complete return of the blue-green color material in the emulsion when this bleach fixing bath is used a single time. This change in the pH value takes into account the small amount of the developing solution which would be carried into the bleach fixing solution in the case of a small processer for a one-time developing.

I wish it to be understood that I do not desire to be limited to the exact details shown and described, for obvious modifications will occur to a person skilled in the art.

Having thus described the invention, what I claim as new and desire to be secured by Letters Patent, is as follows:

1. A color-positive process for producing a color surface picture using an image exposed color paper having diffusion-resistant and protected color couplers or plastic-coated or plastic-uncoated color paper of color negatives, the steps comprising:

color developing the picture at a temperature in the range of from about 20° C to about 50° C with a paraphenylene diamine developer having added thereto a development accelerator having the formula:

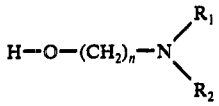

wherein $R_1$ and $R_2$ are H, $CH_3$, or $CH_2$—$CH_3$ and $n$ is in the range of 1 to 4;

bleach fixing and stabilizing the picture in a solution including ethylene-diamine tetraacetic acid iron-sodium complex, ammonium thiosulfate and sodium sulfite, said solution having a pH of from about 5.5 to about 6.0, said process being carried out without any intermediate step of washing or a stop-fixing bath; and thereafter, washing the picture.

2. The process as claimed in claim 1, wherein the solution for the bleach-fixing includes a benzotriazole or a substituted benzotriazole.

3. The process as claimed in claim 2, wherein the temperature is about 23° C.

4. The process as claimed in claim 1, wherein the developer includes a preservative, alkali, a retarder, and diffusion regulators, and and wherein the bleach fix solution includes a halogen-alkylated amino benzotriazole having a strong post-development inhibiting effect and a UV absorber which remains in the emulsion to a sufficient extent after washing to protect the image dyes from bleaching under the action of light.

5. The process as claimed in claim 1, wherein the developer includes temperature-dependent diffusion regulators.

6. The process as claimed in claim 5, wherein the developer includes hydroxyalkyl amines as the accelerator and ω-alkylated-α,-dihydroxyethers as the temperature-dependent diffusion regulators.

7. The process as defined in claim 1, wherein said accelerator is employed in amounts of from about 0.4 to about 5.0ml/l of solution of said developer.

8. The process as defined in claim 1, wherein the developer further includes about 5 to 15 ml/l of a glycol ether having the following formula $$HO-(CH_2)_n-O-(CH_2)_n-OH$$

wherein $n$ is an integer of 1 - 4.

* * * * *